United States Patent [19]

Langen

[11] Patent Number: 4,690,342

[45] Date of Patent: Sep. 1, 1987

[54] TEXTILE MACHINE FOR PRODUCING CROSS-WOUND BOBBINS

[75] Inventor: Manfred Langen, Mönchengladbach, Fed. Rep. of Germany

[73] Assignee: W. Schlafhorst & Co., Moenchengladbach, Fed. Rep. of Germany

[21] Appl. No.: 844,816

[22] Filed: Mar. 27, 1986

[30] Foreign Application Priority Data

Mar. 30, 1985 [DE] Fed. Rep. of Germany ..... 3511735

[51] Int. Cl.[4] ..... B65H 67/06

[52] U.S. Cl. ..... 242/35.5 A; 198/347; 198/420; 198/468.8

[58] Field of Search ..... 242/35.5 A, 35.5 R, 242/35.6 R, 18 R; 198/347, 468.8, 420

[56] References Cited

U.S. PATENT DOCUMENTS

| | | | |
|---|---|---|---|
| 3,788,054 | 1/1974 | Haussmann et al. | 198/347 X |
| 3,926,299 | 12/1975 | Bradley et al. | 198/347 |
| 3,987,974 | 10/1976 | Mayer | 242/35.5 A |
| 4,170,285 | 10/1979 | Hinchcliffe | 198/347 |
| 4,340,187 | 7/1982 | Schippers et al. | 242/35.5 A |
| 4,427,158 | 1/1984 | Conrad | 242/35.5 A |
| 4,541,577 | 9/1985 | Suzuki et al. | 242/35.5 A |
| 4,541,578 | 9/1985 | Kawarabashi et al. | 242/35.5 A |
| 4,565,278 | 1/1986 | Asai et al. | 242/35.5 A |
| 4,582,270 | 4/1986 | Asai et al. | 242/35.5 A |
| 4,591,106 | 5/1986 | Gay | 242/35.5 A X |

FOREIGN PATENT DOCUMENTS

| | | | |
|---|---|---|---|
| 2800570 | 7/1979 | Fed. Rep. of Germany | 198/347 |

*Primary Examiner*—Stanley N. Gilreath

*Attorney, Agent, or Firm*—Herbert L. Lerner; Laurence A. Greenberg

[57] ABSTRACT

A textile machine for producing cross-wound bobbins includes a bobbin conveyor belt disposed along the length of the textile machine for receiving and transporting finish wound bobbins away from the textile machine, a device for switching the bobbin conveyor belt on and off, and a controllable bobbin depositing device including a device for raising and lowering the bobbin depositing device and a device for temporarily storing a row of bobbins from the conveyor belt at a distance above the bobbin conveyor belt being greater than the height of the bobbins.

6 Claims, 5 Drawing Figures

TEXTILE MACHINE FOR PRODUCING CROSS-WOUND BOBBINS

The invention relates to a textile machine for producing cross-wound bobbins, comprising a bobbin conveyer belt being disposed alongside the textile machine and being switchable on and off for accepting and transporting finish bobbins away from the machine.

The bobbin conveyor belt also has a storage function, but this capability is very limited. At the latest, after the bobbin conveyor belt is completely filled with bobbins, the belt has to be rapidly emptied, in order to continue with the winding operation. For this reason, the intervals between the bobbin removal operations are very short in some cases, so that only a very limited number of bobbins can be removed at a time. Often the receiving containers cannot be filled during one removal cycle and have to move along when only partly filled, or they remain in place waiting for the next operation, thereby blocking the passages between the machines.

It is accordingly an object of the invention to provide a textile machine for producing cross-wound bobbins, which overcomes the hereinafore-mentioned disadvantages of the heretofore-known devices of this general type, and which makes the removal of the cross-wound bobbins more flexible by creating an expanded storage capability in order to effect a speedy removal of a greater number of bobbins during greater time intervals.

With the foregoing and other objects in view there is provided, in accordance with the invention, a textile machine for producing cross-wound bobbins or cheeses, comprising a bobbin conveyor belt disposed alongside the length of the textile machine for receiving and transporting finish wound bobbins away from the textile machine, means for switching the bobbin conveyor belt on and off, and a controllable bobbin depositing or distributing device including means for raising and lowering the bobbin depositing device and means for temporarily or transitorily storing or holding a row of bobbins from the conveyor belt at a distance above the bobbin conveyor belt being greater than the height of the bobbins.

In accordance with another feature of the invention, the bobbin depositing device includes two longitudinal carriers for carrying bobbins, the carrier being raised and lowered by the raising and lowering means. The cross-wound bobbins lie on the longitudinal carriers. After the longitudinal carriers have been lowered, the cross-wound bobbins lie on the conveyor belt.

In accordance with a further feature of the invention, there are provided means for moving at least one of the carriers laterally away from the bobbins. For example, if the cross-wound bobbins are first deposited on the bobbin depositing device, they can all be simultaneously placed onto the bobbin below, after the longitudinal carriers have been lowered. The longitudinal carriers have to be subsequently raised again and they must clear the cross-wound bobbins which lie on the conveyor belt. For this reason, at least one of the two longitudinal carriers has to be moved laterally away from the bobbins.

In accordance with an added feature of the invention, the bobbin depositing device includes a horizontal frame with longitudinal carriers disposed at the left and the right of the conveyor belt, the raising and lowering means including at least one controllable lifting element attached to the frame for lowering the carriers below bobbins on the bobbin conveyor belt. In this embodiment, the capability of bypassing the bobbins laterally is not necessary.

In this construction, the intention is to first deposit the bobbins onto the bobbin conveyor belt and to then lift them by raising the frame far enough above the conveyor belt that new bobbins can be placed onto the conveyor belt below the lifted row of bobbins.

In accordance with an additional feature of the invention, the bobbin depositing device includes at least one other frame disposed at a distance above the first-mentioned frame being somewhat greater than the height of the bobbins. If there are two or more frames provided on top each other, two or more rows of bobbins can be lifted on top of each other above the conveyor belt and can then be lowered successively in sequence onto the conveyor belt after the belt has been emptied.

In accordance with a concomitant feature of the invention, there is provided at least one other bobbin depositing device, the textile machine being subdivided into production sections disposed along the length of the textile machine each having one of the bobbin depositing devices. In this case each production section can handle a different batch and be emptied by the same bobbin conveyor belt, without mixing the different batches. The bobbins of the batch which are not to be removed are simply held back from the conveyor belt with the aid of the bobbin depositing device, while the bobbins of the batch to be removed remain on the conveyor belt and are removed. After one batch has been removed, the second batch receives its turn, and so on, depending on how many batches are produced and how many production sections are provided at the textile machine which produces the cross-wound bobbins.

Other features which are considered as characteristic for the invention are set forth in the appended claims.

Although the invention is illustrated and described herein as embodied in a textile machine for producing cross-wound bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
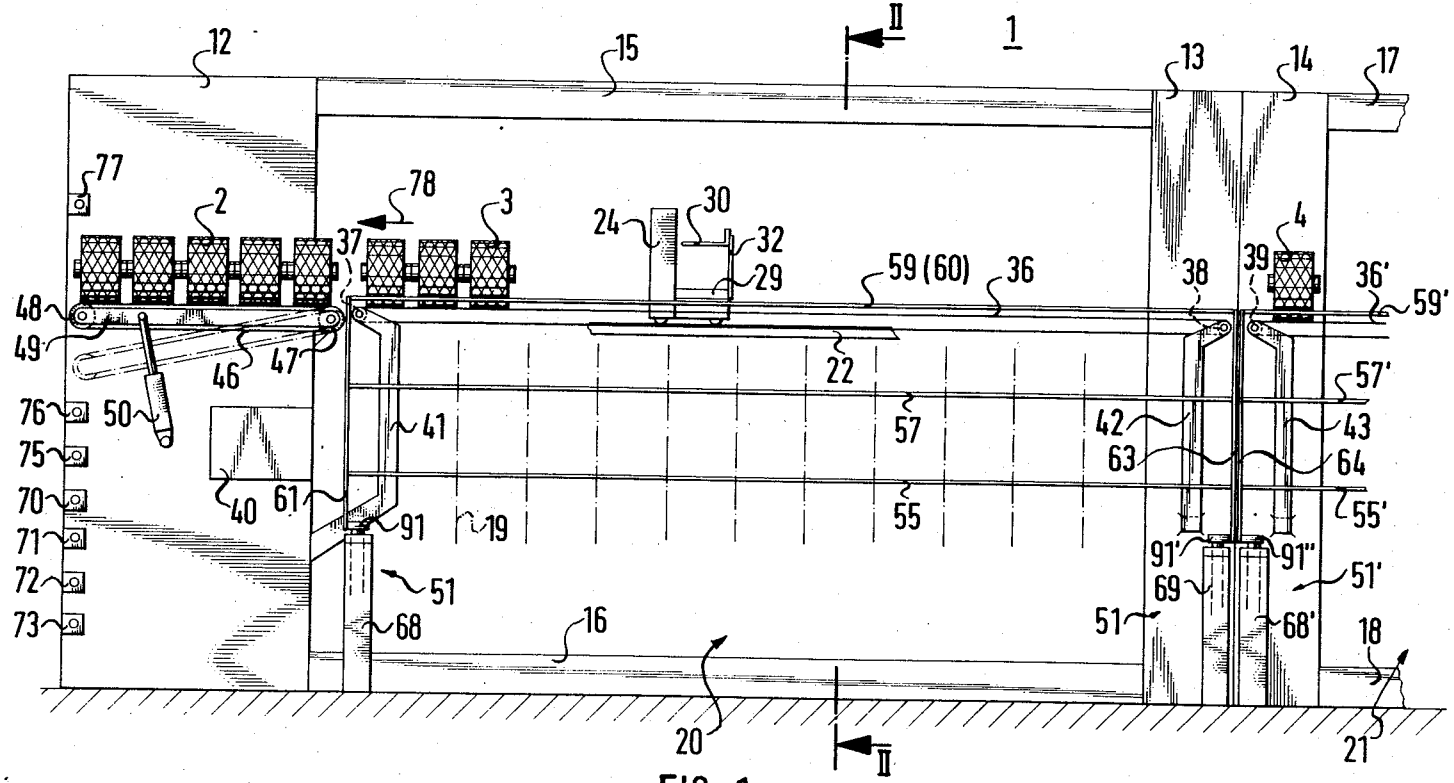
FIG. 1 is a fragmentary, diagrammatic, front-elevational view of a textile machine for producing cross-wound bobbins or cheeses.

Referring now to the figures of the drawings in detail and first, particularly, to the first embodiment of the invention according to FIGS. 1 to 4, there is seen a textile machine which produces cross-wound bobbins or cheeses, and which is designated as a whole with reference numeral 1. The textile machine has an end frame 12, intermediate frames 13, 14 and an additional non-illustrated end frame. The end frame 12 is connected with the intermediate frame 13 by traverses or cross pieces 15 and 16. The intermediate frame is connected with the other non-illustrated end frame by traverses or cross pieces 17 and 18.

The textile machine as a whole includes twenty cross-wound bobbin winding units which are symbolically indicated in FIG. 1 by vertical center lines 19. Ten of the winding units are distributed on a production section 20, which extends between the intermediate frame 13 and the end frame 12, and ten of the winding units are disposed on a production section 21, which extends between the intermediate frame 14 and the other end frame. An automatic cross-wound bobbin changer 24 can travel in each of the two production sections 20, 21 on rails 22 which are positioned along the sides of the textile machine 1.

Each cross-wound bobbin winding unit 19 is provided with a thread delivering device 25, a winding roller 26 having reversing thread grooves, which serves for guiding the thread and driving a respective cross-wound bobbin or cheese which is being wound, and a winding frame 27 which supports the bobbin. A thread 28 is pulled out of the thread delivering device 25, conducted through the reversing threads of the winding roller 26, and thereafter wound onto the cross-wound bobbin or cheese which is just being wound. According to FIG. 2, this relates to a bobbin 6, according to FIG. 3 it relates to a bobbin 7, and according to FIG. 4 it relates to a bobbin 8.

The cross-wound bobbin changer 24 has a table 29, which is inclined toward the rear and a spool-fetching arm 30. The spool fetching arm 30 is disposed horizontally and sits at the end of an angular rod 31. The rod 31 articulates with a parallel guiding device, formed of two levers 32, 33 which can swing synchronously in a vertical plane. The pivot axes of the levers 32, 33 are designated with reference numerals 34 and 35, respectively.

A bobbin conveyor belt or transport band 36, 36' is conducted alongside the textile machine 1. Actually, the bobbin conveyor belt could be continuous from one end frame to the other, but the conveyor belt illustrated in the drawings is subdivided into two belt section 36, 36', which are each provided with belt rollers 37, 38, 39 at the ends thereof. The rollers 37 and 39 can be driven by integrated belt roller motors. The belt roller motors of the belt rollers 37 and 39 are functionally connected to a central control device 40 which is located at the end frame 12. The belt rollers are supported by brackets 41 to 43.

According to FIG. 1 a short transfer belt or band 46 is adjacent the bobbin conveyor belt 36. The short belt 46 can accept at most 5 bobbins or cheeses 2. The transfer belt 46 runs on belt rollers 47 and 48. The belt roller 47 can be driven by a belt roller motor, which is functionally connected to the control device 40. The two belt rollers 47 and 48 are connected with each other by a bar 49. The bar 49 articulates with a pneumatic lifting device 50. The lifting device 50 serves the purpose of adapting a transfer point to the height or vertical position of non-illustrated transporting means, which accept the cross-wound bobbins.

The bobbin conveyor belt 36 has a bobbin deposition or distributing device 51, which can be raised or lowered, and the conveyor belt 36' has a similar bobbin distributing or deposition device 51'. The bobbin deposition or distributing devices, which can also be referred to as cuttling frames, serve for the temporary storage of a row of bobbins which lies more than one bobbin-height above the bobbin conveyor belt 36, 36', such as the row of bobbins 5 according to FIG. 3.

The construction of such a bobbin depositing or distributing device will be explained using the bobbin distributing device 51 as an example. The bobbin distributing device 51 is shown in particular in FIGS. 2 to 4. As a whole, the device 51 has three frames 52, 53, 54 which are disposed on top of each other and spaced at a distance somewhat greater than the height of a bobbin. Each frame has longitudinal carriers to the left and to the right below the spools deposited on the bobbin conveyor belt 36, such as the spools 5 according to FIG. 4. The frame 52 has longitudinal carriers 55 and 56, the frame 53 has longitudinal carriers 57 and 58, and the frame 54 has longitudinal carriers 59 and 60.

Only longitudinal carriers 55', 57' and 59' of the bobbin depositing or distributing device 51' are visible in FIG. 1.

The longitudinal carriers 55, 57 and 59 are connected with each other at both ends by vertical supports, and the same applies for the longitudinal carriers 56, 58, and 60. This also applies for the corresponding longitudinal carriers of the other bobbin depositing or distributing device 51'. According to FIG. 2, the longitudinal carriers 55, 57 and 59 are interconnected by a vertical support 61 and the longitudinal carriers 56, 58 and 60 are interconnected by a vertical support 62. According to FIG. 1, the longitudinal carriers 55', 57' and ▽' of the other bobbin depositing or distributing device 51', are interconnected by a vertical support 64. Additional vertical supports are not shown in the drawings.

The vertical supports are disposed in pairs and their mutual spacing is somewhat greater than the distance between the support rods or frames 55 and 56.

The vertical supports of each pair of vertical supports are interconnected by three traverses or cross pieces 65, 66 and 67 which are disposed at different heights or levels. In this way, the vertical supports, the longitudinal carriers and the traverses form a stable structure, which can even be further stabilized by additional vertical supports which are not illustrated in the drawings.

Figure 2:
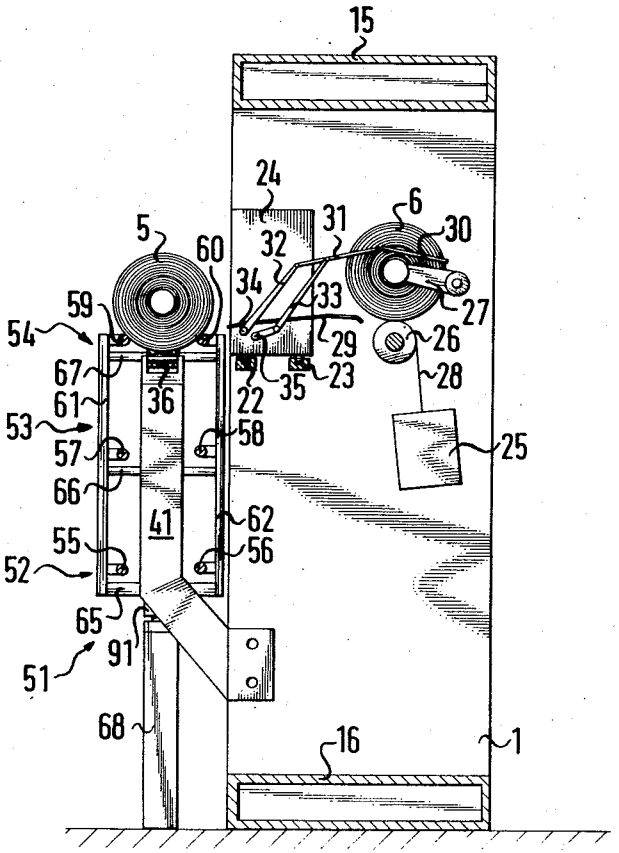
FIG. 2 is a cross-sectional view of the textile machine taken along the line II—II of FIG. 1, in the direction of the arrows, with a spool or bobbin distributing device which has not yet been lifted.

The lower traverse 65 which at the right end of the longitudinal carriers 55, and 57 and 59 is connected with the vertical support 63, is held by an angle piece 91'. At the other bobbin distributing device 51' the lower traverse which is connected to the vertical support 64 is held by an angle piece 91''. The traverse 65 is connected by an angle piece 91 to a controllable lifting element 68. The angle piece 91' is connected to a similar controllable lifting element 69. The lower traverse of the device 51' is connected with a similar lifting element 68'. Accordingly, for example, the frames 52, 53 and 54 shown in FIG. 2 are in connection with the two lifting elements 68 and 69. The lifting elements are constructed in the form of pneumatic piston devices. All of the lifting elements are functionally connected to the control device 40. The lifting devices can be operated in pairs.

Figure 3:
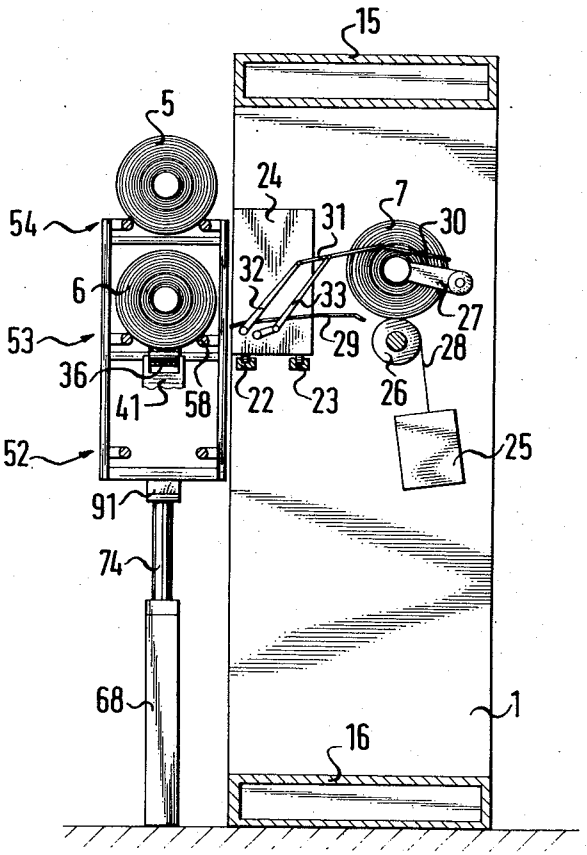
FIG. 3 is a view of the textile machine similar to FIG. 2, with the spool distributing device lifted one level high.

The apparatus according to the invention functions as follows:

It is assumed that the cross-wound bobbins 3 and 5 have already been deposited on the conveyor belt 36, but have not yet been removed. This starting condition is shown in particular in FIG. 2. In order to proceed with the winding operation, the whole row of bobbins must be raised or lifted one tier or level. For this purpose, it is necessary to operate a switch 70, which is functionally connected to the control device 40. The control device 40 then runs through a program which initiates the pneumatic activation of the two lifting elements 68 and 69. Starting from the position shown in FIG. 1, the two longitudinal carriers 59 and 60 contact the row of bobbins 5, as shown in FIG. 2, and the frames 52, 53 and 54 move into a position which is one tier or level higher than the starting position by moving piston rods 74 out of the lifting elements 68 and 69. Since the row of bobbins 5 therefore lies at a sufficient distance above the bobbin conveyor belt 36 as shown in FIG. 3, the bobbin changer 24 can exchange bobbins and, for example, can place the bobbin 6 shown in FIG. 2 onto the bobbin conveyor belt 36.

This is accomplished in the following way: The two levers 32 and 33 are synchronously swing counterclockwise after the bobbin winding frame 27 has been opened. The spool-fetching arm 30 takes along the bobbin 6 and lets it roll over the table 29 and the longitudinal carrier 58 onto the conveyor belt 36, as shown in FIG. 3. In this way the bobbin changer 24 can sequentially exchange bobbins and roll them onto the conveyor belt 36.

If the conveyor belt 36 is subsequently filled for the second time and has to be emptied again, a switch 71 at the end frame 12 is operated. The switch 71 is also functionally connected to the control device 40.

After the switch 71 has been operated, the program in the control device 40 advances one operational step and again simultaneously pneumatically activates the two lifting elements 68 and 69. According to FIG. 4, the piston rods 74 extend further, until the frames 52, 53 and 54 again lie one tier or level higher.

Figure 4:
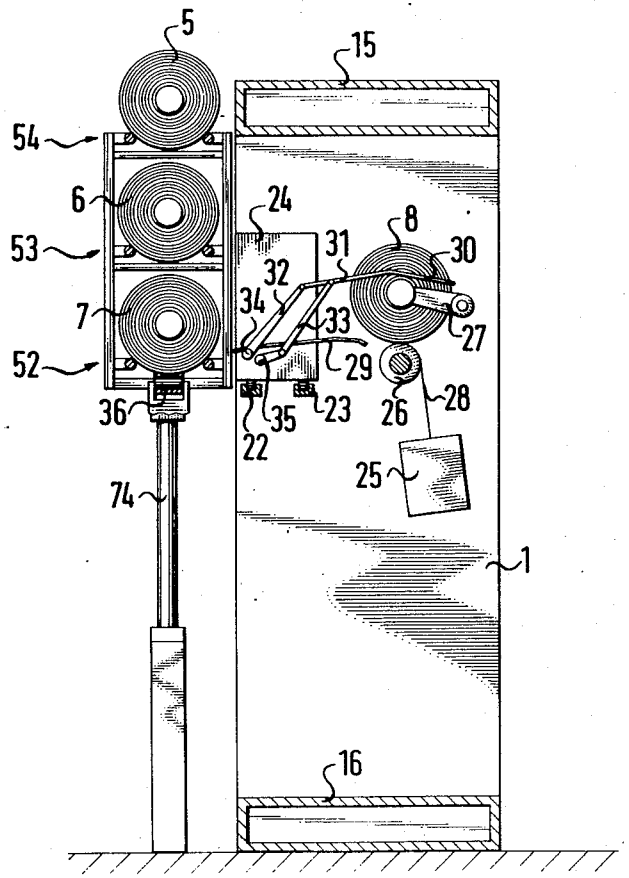
FIG. 4 is another view of the textile machine similar to FIG. 2, with the spool distributing device lifted two levels high.

As shown in FIG. 4, two rows of cross-wound bobbins 5 and 6 are positioned at a distance above the bobbin conveyor belt 36, so that, for example, the bobbin 7 which is still in the winding unit can be rolled onto the conveyor belt 36 with the aid of the bobbin changer 24.

If the bobbin conveyor belt 36 is then filled a third time, the removal operation can start. The row of bobbins 7 which was placed onto the conveyor belt 36 at last, is the first to be removed. A switch 72 at the end frame 12 which is also functionally connected to the control device 40, is subsequently operated. This functional connection causes the reverse operation of the device by one step, so that the two lifting elements 68 and 69 are moved at the same time until the frames 52, 53 and 54 are at the height or vertical position shown in FIG. 3. This row of bobbins can then be removed and if a switch 73 at the end frame 12 which is also functionally connected to the control device 40 is subsequently operated, the program again moves the mechanism one step backward, so that the lifting elements 68 and 69 are completely pneumatically deactivated. The frames 52, 53 and 54 therefore again move into their starting position and the row of bobbins 5 can also be removed. The removal is initiated by operating a switch 75 at the end frame 12. This switch is also functionally connected to the control device 40. The device 40 sets the motor of the two belt rollers 47 and 37 in motion after the switch 75 has been operated. The removal of the bobbins is always performed in the direction of an arrow 78. After the bobbins are removed, a switch 77 is operated, which is also functionally connected with the control device 40, which turns off the motors of all of the belt rollers.

However, starting with the position shown in FIG. 4, there is also a second method of operating the bobbin conveyor belt 36. By additionaly operating the switch 71, it is possible to extend the two piston rods 74 even higher by about two centimeters, so that the row of bobbins 7 just loses contact with the conveyor belt 36. If the switch 75 is then operated, the belt rollers 47 and 37 are driven, but the bobbin conveyor belt 36 runs empty. Therefore, only the bobbins 2 on the conveyor belt 46 which may originate from a previous batch, are removed. The belt rollers are subsequently stopped by operating the switch 77 and then the rows of bobbins 5, 6 and 7 can be removed one after the other, starting from the position shown in FIG. 4.

For example, if only the conveyor belt 36' is emptied, it is necessary to lift the bobbins lying on the conveyor belt 36. During the removal, no bobbin exchange should be performed. Since the removal of the bobbins only takes a short time, this interruption of the exchange of bobbins in the production section 20 for a short period is acceptable.

Because of the subdivision of the conveyor belt, it becomes possible to cross the traverses 65 to 67 in a vertical plane at the ends of the belt sections. If only a single continuous bobbin conveyor belt 36 was used, the traverses 66 and 67 would have to be omitted, although this could be compensated by a more stable configuration of the remaining vertical supports 61 to 64 in a lower position.

Figure 5:
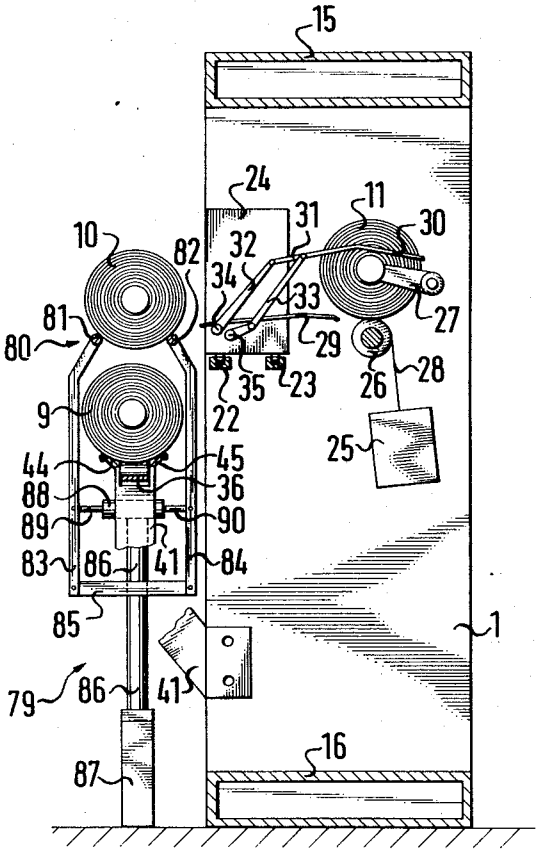
FIG. 5 is a further view of the textile machine similar to FIG. 2, with an alternate version of a spool distributing device.

The embodiment according to FIG. 5 differs from the embodiment according to FIGS. 2 to 4 as follows:

A bobbin depositing or distributing device 79 shown in FIG. 5 has only one frame 80 with two longitudinal carriers 81 and 82. Each longitudinal carrier is disposed at the upper end of two vertical supports. FIG. 5 only shows two vertical supports 83 and 84. The pair of vertical supports articulates with a bracket which is attached to the piston rod of a lifting element that is constructed in the form of a pneumatic cylinder. FIG. 5 shows that the two vertical supports 83 and 84 articulate with a bracket 85, which is disposed at the upper end of a piston rod 86 of a lifting element 87. The same piston rod 86 carries a small, horizontally oriented pneumatic cylinder 88 at the upper end thereof, from which piston rods 89 and 90 extend in opposite directions. The piston rod 89 articulates with the support 83 and the piston rod 90 articulates with the support 84.

If the pneumatic cylinder 88 is activated by compressed air, the two vertical supports 83 and 84 spread apart, so that the longitudinal carriers 81 and 82 can move out of the way of a bobbin or row of bobbins, as will be explained below.

According to FIG. 5, the bobbin is deposited by the bobbin changer 24 directly onto the longitudinal carriers 81 and 82 of the bobbin depositing or distributing device 79. According to FIG. 5, there is already a row of bobbins 10 on the frame 80. After the row of bobbins 9 which lies below the bobbins 10 on the conveyor belt 36 has been removed, the lifting element 87 can be deactivated, so that the row of bobbins 10 moves into the position of the row of bobbins 9. At this point, the two longitudinal carriers 81 and 82 are positioned below the row of bobbins on the conveyor belt 36 and have to be immediately moved again to the higher tier or level into the old position. In order to accomplish this, the pneumatic cylinder 88 is activated by compressed air, so that the supports 83 and 84 are spread apart and the longitudinal carriers 81 and 82 can pass the row of bobbins at the sides. Then, the pneumatic cylinder 88 is deactivated again, so that after the piston rod 86 is fully extended the frame 80 is again in its old position as shown in FIG. 5, and can accept new bobbins 11.

Deviating from the embodiment according to FIGS. 2 to 4 wherein the row of bobbins on the conveyor belt 36 is guided at the side by the longitudinal carriers of the frames 52, 53, 54, support rods 44 and 45 which are fastened to the bracket 41 are provided for this purpose according to the embodiment of FIG. 5.

I claim:

1. Textile machine for producing cross-wound bobbins, comprising a bobbin conveyor belt disposed along the length of the textile machine for receiving and transporting finish wound bobbins away from the textile machine, means for switching said bobbin conveyor belt on and off, a controllable bobbin depositing device, means for transferring the bobbin between said bobbin conveyor belt and said bobbin depositing device, and means for raising said bobbin depositing device for temporarily storing a row of bobbins from said conveyor belt on said bobbin depositing device with said transferring means at a distance above said bobbin conveyor belt greater than the height of the bobbins and for lowering said bobbin depositing device for returning a row of bobbins from said bobbin depositing device to said conveyor belt with said transferring means.

2. Textile machine for producing cross-wound bobbins according to claim 1, wherein said bobbin depositing device includes two longitudinal carriers for carrying bobbins, said carriers being raised and lowered by said raising and lowering means.

3. Textile machine for producing cross-wound bobbins according to claim 2, including means for moving at least one of said carriers laterally away from the bobbins.

4. Textile machine for producing cross-wound bobbins according to claim 1, wherein said bobbin depositing device includes a horizontal frame with longitudinal carriers disposed at opposite sides of said conveyor belt, said raising and lowering means including at least one controllable lifting element attached to said frame for lowering said carriers below bobbins on said bobbin conveyor belt.

5. Textile machine for producing cross-wound bobbins according to claim 4, wherein said bobbin depositing device includes another frame disposed at a distance above said first-mentioned frame being greater than the height of the bobbins.

6. Textile machine for producing cross-wound bobbins according to claim 1, including at least one other bobbin depositing device, and production sections disposed along the length of the textile machine each having one of said bobbin depositing devices.

* * * * *